US012342876B1

(12) United States Patent
Anderson et al.

(10) Patent No.: US 12,342,876 B1
(45) Date of Patent: Jul. 1, 2025

(54) POLYMERIC BREAST SUPPORT STRUCTURE

(71) Applicants: Kristen Anderson, Cheshire, CT (US); Divya Chaurasia, Brooklyn, NY (US); Monika Harris, Brooklyn, NY (US); Bridget Mollner, Minneapolis, MN (US); Delilah Roberts, Madison, WI (US); Isis Shiffer, Brooklyn, NY (US); Jasmine Stroud, Brooklyn, NY (US); Riley Walker, Amelia, OH (US)

(72) Inventors: Kristen Anderson, Cheshire, CT (US); Divya Chaurasia, Brooklyn, NY (US); Monika Harris, Brooklyn, NY (US); Bridget Mollner, Minneapolis, MN (US); Delilah Roberts, Madison, WI (US); Isis Shiffer, Brooklyn, NY (US); Jasmine Stroud, Brooklyn, NY (US); Riley Walker, Amelia, OH (US)

( * ) Notice: Subject to any disclaimer, the term of this patent is extended or adjusted under 35 U.S.C. 154(b) by 0 days.

(21) Appl. No.: 18/389,184

(22) Filed: Nov. 13, 2023

Related U.S. Application Data

(60) Provisional application No. 63/383,783, filed on Nov. 15, 2022.

(51) Int. Cl.
*A41C 3/12* (2006.01)

(52) U.S. Cl.
CPC ..... *A41C 3/128* (2013.01); *A41C 3/124* (2013.01); *A41C 3/126* (2013.01)

(58) Field of Classification Search
CPC ..... A41C 3/128; A41C 3/124; A41C 3/142; A41C 3/14; A41C 3/0007
USPC ..... 450/41
See application file for complete search history.

(56) References Cited

U.S. PATENT DOCUMENTS

| | | | | |
|---|---|---|---|---|
| 2,992,646 | A * | 7/1961 | Weinberg | A41C 3/0007 450/80 |
| 6,425,800 | B1 * | 7/2002 | Huang | A41C 3/0007 450/41 |
| 2002/0193048 | A1 * | 12/2002 | Kato | A41C 3/128 450/1 |
| 2006/0046614 | A1 * | 3/2006 | Hsu | A41C 3/0014 450/1 |
| 2007/0298681 | A1 * | 12/2007 | Liu | A41C 3/122 450/39 |
| 2015/0044941 | A1 * | 2/2015 | Luxi | A41C 3/10 450/41 |
| 2019/0382572 | A1 * | 12/2019 | Matayoshi | C08J 9/08 |
| 2021/0084994 | A1 * | 3/2021 | Rabinowicz | A41C 3/128 |

* cited by examiner

*Primary Examiner* — Timothy K Trieu
(74) *Attorney, Agent, or Firm* — Larisa Migachyov

(57) ABSTRACT

A polymeric breast support structure to be incorporated into a breast support garment such as a bra, bustier, swimsuit, or similar, comprising a soft polymeric material and a wide cross-section that provides support without discomfort.

20 Claims, 11 Drawing Sheets

POLYMERIC BREAST SUPPORT STRUCTURE

CROSS-REFERENCE TO RELATED APPLICATIONS

The present application takes priority from Provisional App. No. 63/383,783, filed Nov. 15, 2022, which is herein incorporated by reference.

BACKGROUND OF THE INVENTION

Field of the Invention

The present invention relates generally to undergarments and more particularly to breast support garments.

Background of the Invention

Bras and other breast support garments, including brassieres, tank tops, shapewear and swimming suit tops are used to lift and support breast tissue. Oftentimes, to help create lift and support, these garments utilize "underwires", two U-shaped metal components, each of which is integrated into the cup of a bra or other breast support garment and provides a "cradle" for each breast to rest within. The underwire is positioned in a bra such that the bottom, curved cradle portion of the U-shaped component sits directly underneath of each breast. The first end of underwire sits at the wearer's sternum, while the second end of the underwire sits near the wearer's underarm when the underwire is sewn into a bra or related garment and worn by a wearer. Therefore, a single underwire starts at the center of the wearer's body near the sternum, curves downs to underneath of the bottom of the breast, and then curves back-up to near the underarm area, all following the U-shaped curve.

The traditional underwire lifts the wearer's breasts into a desirable position and prevents sagging of the breast tissue. The U-shaped curve helps provide a more rounded, fashionable shape to the wearer's breasts. Because each breast sits within its own U-shaped underwire component, the traditional underwire also serves to separate the two breasts from one another, preventing the wearer from experiencing "uni-boob". Uni-boob occurs when both breasts are compressed to the midline of the body such that they touch together. This creates an undesirable look and can be uncomfortable for the wearer, especially if they sweat and/or their breast tissue rubs together. Underwires create separation by ensuring space between the breasts and preventing the tissue from being pressed together. By supporting, shaping and separating, underwires contribute to a more desired aesthetic of a bra.

While traditional underwire is U-shaped, it does not incorporate 3D radial geometry. In other words, while the U-shape has curve, it is only a 2-dimensional curve, as traditional underwires are flat and exist in a singular plane. Traditional underwires do not have a 3D radial design and are not designed around a central point of a spherical shape. They do not incorporate curves circumferentially around a central axis, and therefore are not designed to follow along the radial curvature of the body.

As mentioned, traditional underwires are flat in 2-dimensional space and do not conform to the natural contours of the wearer's body. The body does not exist in linear or 2-dimensional form, but rather is curved and 3-dimensional. For example, a body standing up has length in the y direction (their height), the x direction (wingspan when arms are outstretched perpendicular to body), and also depth in the z direction (front torso to back). There is significant curvature in all directions, particularly in the chest area of the body where a bra and the underwire would sit. In the z-direction alone, the sternum is at a different depth relative to the ribs underneath the breasts and the ribcage that wraps around the side-body. A linear underwire on a non-linear body results in poor fit and discomfort. In particular, when the body curves inward relative to the underwire (i.e the underwire has a greater value in the z-direction relative to the body), gaps can exist between the body and the underwire, which render the underwire less effective and supportive. When the body curves outward relative to the underwire (i.e the underwire has a lessor value in the z-direction relative to the body), digging can occur as the underwire presses uncomfortably deep into the body. This digging often happens at the sternum, near the ribs, and at the side-body resulting in pressure points and red marks on the body.

Because the traditional underwire is flat and does not conform to the body's 3D curves, in many cases it will not "tack" well to the body. Tacking occurs when the end of the underwire at the sternum sits comfortably on the body. If tacking does not occur, there is a gap or measurable distance between the underwire and the body. Tacking ensures a comfortable fit, good support, and that each of the breasts are separated from each other so there is no uni-boob. Oftentimes, underwires because of their flat, 2D design, do not tack to the body.

Traditional underwires have two distinct ends due to their U-shape. These ends are prone to poking the body. The first end of the underwire may poke the sternum, while the second end of the same underwire may poke a wearer's underarm and side-body. These areas of the body can be particularly sensitive, and pain can result from the metal underwire poking and stabbing these body parts. Even with padding or covering over the ends of the underwires, the poking to these sensitive body areas can cause discomfort.

Of note, this pain due to the wire ends can be especially uncomfortable at the wearer's sternum because traditional underwires come in pairs and each individual pair has a wire end at the sternum. Thus, two wire ends (one from each underwire) have the potential to poke the sternum of the body. Eliminating wires that terminate at the sternum would provide increased comfort for the wearer. Instead of two independent and separate underwires (one single underwire being integrated into one cup of a bra or other bra-related garment to support the first breast, while the other underwire being integrated into the bra cup to support the second breast) both having wire ends at the sternum, a single continuous design that connected the underwires seamlessly and eliminated any wire terminations at the sternum would reduce poking and increase comfort.

Typically, underwires are made from rigid metal, which does not allow for a significant degree of bending and flexing. As a result, underwires do not conform well to the body's natural curvature and movements. As the body itself leans over, bends sideways, arches back, twists, etc., the rigid underwire is not able to conform well to those bodily changes and movements, resulting in more poking, pinching and discomfort. The underwire may also not tack as well on the body because of its rigidity.

Further, because traditional underwires are made from rigid metal, they do not adapt well to changes to a specific wearer's body. A wearer's breast tissue may change in shape and volume throughout various life events, including general aging, pregnancy, weight loss/gain, time within monthly menstrual cycle, etc. A rigid, metal underwire is generally non-conforming and lacks the flexibility to adjust and accommodate changes in breast tissue volume and other fluctuations in breast size or shape, resulting in discomfort for the wearer as their body changes.

Furthermore, because the rigid metal is not flexible, a single traditional underwire will only accommodate a very narrow range of bra cup sizes. For example, one single underwire might be made to fit a 34B bra cup and its sister size bra cups (i.e., 32C, 30D, 28DD, 36A). If an underwire was made of a different, more flexible material then it could be capable of fitting a wider range of bra cup sizes.

Because underwires are typically made of metal, they cannot be sewn directly into a bra or other bra-related garment, as sewing needles are unable to puncture the hard metal material. Instead, underwire casings or channeling is often used. This casing or channeling is a tubular casing that houses the underwire. The casing itself is made of fabric such that it can be sewn to the bra, more specifically the bra cups, to hold the underwire close to the body. The underwire channeling can also be sewn to the gore, the center piece of fabric that connects both cups of a bra together. This additional step of adding the casing also provides a layer between the underwire and the skin, which enhances comfort and prevents the wearer's skin from being directly exposed to the hard corners and edges of the underwire. However, the ends of the underwires are prone to puncture through the channeling, exposing the underwire and limiting the useful life of the garment. The need for the channeling is also an extra step in the construction of the bra that adds time and material costs.

Typical metal underwires are usually made of steel, although other alloy metals may also be used. Metals provide sufficient support and rigidity given their high levels of hardness. Hardness is the ability of a material to withstand a force and resist deformation. The harder the material, generally the stiffer and more rigid it is. Metals and harder plastics are usually measured on the Rockwell scale, while rubbers, elastomers and softer plastics are measured on the Shore hardness scale. Harder materials are not as comfortable against the skin, and they are not able to accommodate the soft tissue of the body by bending and flexing as much as softer materials. Further, much of a metal's stiffness and rigidity is due to its high elastic modulus, which measures the material's elasticity and how much it resists being deformed. The elastic modulus of metals is typically higher than that of elastomers and other polymers.

Underwires themselves are very thin and narrow. The cross-sections are thin and narrow because the metal is strong and rigid, and generally a smaller cross-section is able to support the breast tissue. Importantly, if the cross-sections of a traditional metal underwire were to be larger, the underwire would be even more rigid and stiff. It would also be more uncomfortable for the wearer due to the larger, more pronounced edges and corners.

Because the underwires themselves are so thin and narrow, significant tissue weight is placed upon the very small surface area of the underwire. Without a wider area or ledge that could distribute more breast tissue weight, significant pressure is applied where the underwire sits on the body, resulting in pinching and digging. A wearer often develops significant red marks from the pressure of the underwire on the body when worn for extended periods of time.

The cross-section of a traditional underwire is typically rectangular. The hard edges of the cross-section do not follow the curves of the body. The corners of these hard edges can dig into the body and cause general discomfort. Further, the end of the wires can be particularly problematic for the wearer because the rectangular cross-sectional areas at the end of the wires create sharp corners at the body's sternum and underarm area.

Most typically the height of the underwire cross-section is not more than 3 millimeters and the width generally ranges between 0.5 and 1 millimeters. Because the height is so small, and the width is even smaller, there is no ledge or wider area for the breast tissue to rest upon. All of the weight of the breast tissue is concentrated on a very small surface area. This is particularly problematic right underneath the breasts, as a natural connection point forms on the body where the breasts and the chest meet, and a very small, narrow underwire there can dig into the body.

Because underwires are flat, the orientation of the cross-section does not change along the length of the underwire. In other words, the height and the width are flat in two-dimensions (for example, the x and y directions) and do not change orientation in the third dimension (for example, the z direction) along the length of the underwire, as the underwire remains in a singular plane in the third dimension. There is no twisting of the underwire to accommodate the natural curvature of the body, whose side body is almost perpendicular to the front chest. Therefore, when sewn into a garment, the height cross-section of the underwire rests against the body at the bottom of the U-shape of the underwire and at the bottom of each breast at the front chest. However, because the underwire does not twist in the z-direction, the height cross-section does not sit flush with the body closer to the underarm area which is perpendicular to the front chest. Underwire could be improved upon by finding a way to ensure that the height cross-section (which is longer) rests flush with the body along the entire length of the underwire, as this would significantly improve the comfort of underwires because the height cross-section provides more surface area for tissue distribution and prevents the shorter width cross-section from digging into the body.

The cross-section of traditional underwire is uniform throughout the entire length of the underwire. There is no tapering at the end of the underwires. Instead, the abrupt termination at the ends of the wire can result in poking and stabbing due to sharp corners. Sometimes, the ends of the underwires may be covered by a plastic coating or an end cap, or underwire channeling could be used to contain the underwire, soften the edges, and limit the poking of the ends. Additionally, there is no widening of the cross-section of the underwire. Instead, the cross-section at the very bottom of the breast, where there is the greatest tissue weight to support, is the same as the cross-section along the entire length of the underwire, including at places where there is less tissue weight to support.

Traditional underwires are often one of the first things to break in a bra, limiting the wearable life of the garment. Metals have high elastic modulus values, and therefore are not very elastic. Because metal is very rigid, underwire does not stretch, bend or flex much, and it will break if too much pressure is exerted or if it is bent too far beyond its limits. This can be problematic for wearers with heavier breast tissue, where the pressure exerted is greater and underwires are more prone to breakage.

If the pressure is great enough and the deformations are large enough, the traditional underwire will bend beyond its ability to recover. Metal lacks sufficient ability to revert back to its original shape after being substantially deformed or stretched. When the wearer's breasts are large enough, the force exerted may cause underwires to deform so much that they lack sufficient ability to revert back to their original shape. This represents plastic deformation, where the shape of a material stays changed after some force acts upon it. The inability to recover to the original shape continues even after the force is removed. This is in contrast to elastic deformation, where the material goes back to its original form. The plastic deformation and inability to recover to an original shape inherent in metal underwires can limit the wearable life of a bra as the original shape of the underwire is lost.

Further, even if the deformations are small, the metal can become fatigued from repeated deformations. Fatigue occurs when a material is weakened after being subjected to cyclic loading. The repeated wearing of bras weakens the underwire. This weakening can lead to failure, such that the metal underwire eventually breaks. This breakage may injure the wearer as the metal splits, cuts through the underwire casing, and subsequently stabs or pokes the wearer's body. This breakage also renders the garment unwearable.

Because metal underwires are rigid, they require a higher degree of force to deform. In a situation where the underwire was digging, a force at least equal and opposite to that of the underwire would be needed to deform the underwire such that it did not dig into the body. With a metal underwire, that force is higher than other materials, such as a thermoplastic elastomer. Thermoplastic elastomers are more flexible and require a smaller force to deform. All else equal, an underwire made from a thermoplastic elastomer would require less energy for it to be deformed relative to an underwire made from metal. As such, it would be easier to deform the thermoplastic elastomer underwire to better accommodate the specific curves of an individual wearer and enhance comfort. An underwire that is easier to deform is more comfortable and does not dig as much into the body.

While underwires provide direct support underneath each of the wearer's breasts, they do not offer any side support at the wearer's side body. First, many women have breast tissue ("side-boob") that extends further back along their body to the underarm area. Oftentimes, this extra breast tissue in this underarm area is not contained within the underwire, as the underwire does not extend far back enough. Second, wearers often complain of extra tissue on their side-body that bras in general do not contain. The fabric at the side of the bra (at the wearer's underarm and side-body) may bulge out due to this extra side-body tissue. Because underwires end at the underarm, they do not offer any additional side support to help contain both side-body and side-boob tissue and enhance the aesthetic appearance of the bra.

Underwires do not have anything that allows them to be easily integrated into the bra or other breast support garment via a direct method. The metal is too hard to be sewn directly to the fabric of a bra cup. Instead, underwire channelings must be utilized which wrap the underwire in fabric. The fabric of the channeling can then be sewn to the fabric of the bra for an indirect method of attaching the underwire to the garment. Underwires do not have a direct attachment mechanism to the underband of a bra, other than through the channeling. Nor, do underwires offer any additional support to the underband of a bra.

There are slight variations to the shape of an underwire to accommodate various styles of bras such as the demi, plunge, or balconette. In each case, the height of the underwire at the wearer's sternum and underarm may be slightly higher or lower depending on the style. The shape of the underwire may be a deeper or more shallow U-shape or J-shape to accommodate the differing styles.

SUMMARY OF THE INVENTION

In an aspect of the present invention, a polymeric breast support structure for a breast support garment is disclosed. The breast support garment could be a bra, camisole, top, shapewear, bodysuit or a swimsuit top. The breast support structure comprises a right and a left breast support, each comprising a curved contoured member that is shaped to fit under a typical inframammary fold and around a typical ribcage, extending from a user's sternum to under a user's axilla. The cross-section of the right and left breast supports is a shape that is approximately half as wide as it is tall, with a height between 5-15 millimeters, and with no sharp corners. The right and left breast supports are made of a soft material with a Shore hardness level of between A20 to A95 and a modulus of elasticity below 1000 MPa. The material is heat resistant to at least 140 degrees Celsius.

In an embodiment, the right and left breast supports are connected at the sternum. The inside of the sternum connection (i.e. the part that touches the user's sternum) is smooth and flat and comprises no grooves.

In an embodiment, the axillary end of each breast support comprises a side-support panel.

The soft material could be a thermoplastic polyurethane, silicone, a thermoplastic, an elastomer, or a thermoplastic elastomer. In an embodiment, the soft material is a thermoplastic styrenic block copolymer.

The cross-section of each breast support could be an oval, a rectangle with rounded corners, a trapezoid with rounded corners, or a rounded shape with a flat face that is closest to the user's breast when the polymeric breast support structure is worn.

In an embodiment, the cross-section of each breast support is variable, being thicker in the middle than at either the axillary end or the sternum end.

In an embodiment, the polymeric breast support structure comprises an underband attached to both breast supports. The underband fits around a user's ribcage under the breast supports and has a thin flat cross-section that may be integrated into the band of a bra.

In an embodiment, the polymeric breast support structure comprises a sewing ledge attached to each breast support, which is used for sewing the breast supports to a garment.

The ratio between the vertical distance of the sternum end from the lowest point of the inframammary fold and the vertical distance of the axillary end from the lowest point of the inframammary fold can be ⅔-¾, or 1, or ½-⅔, or ⅓.

LIST OF FIGURES

Figure 10:
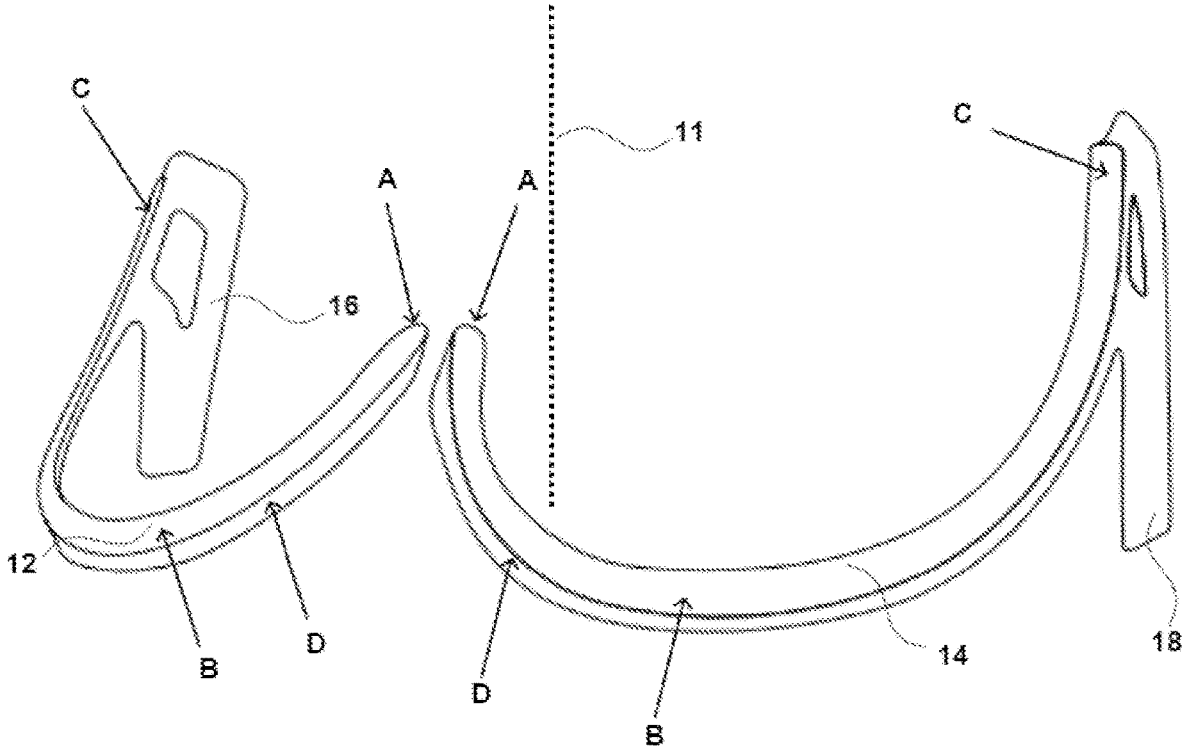
Figure 11:
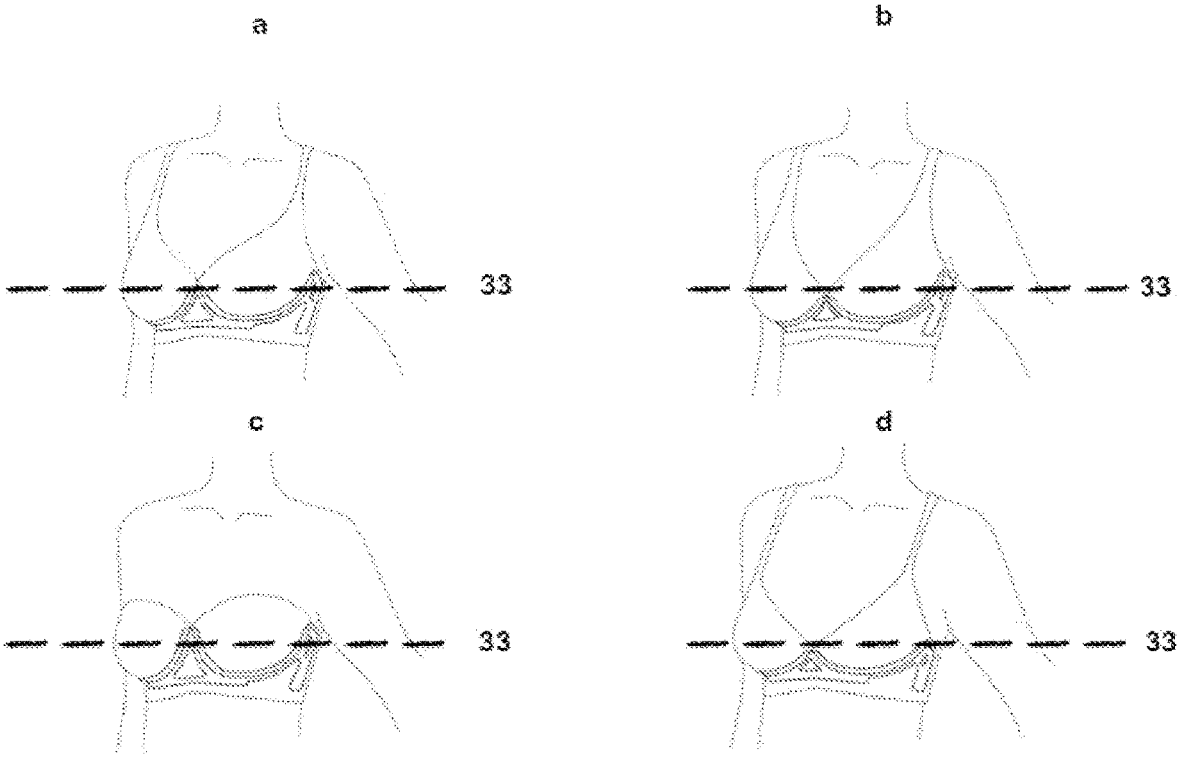

FIG. 10 highlights an embodiment of a polymeric breast support structure where the left and right breast supports are not connected and no underband panel is present;

FIG. 11 shows slight modifications to the breast supports to better fit various bra styles.

DETAILED DESCRIPTION

A polymeric breast support structure for a bra or other breast support garment (including but not limited to bustiers, sports bras, camisoles, swimwear, shapewear, bodysuits) is herein described. Bras and other bra-related garments are typically worn to cover the breast tissue of the wearer, direct the breast tissue volume into a preferred aesthetic shape, and limit movement of the breast tissue.

The polymeric breast support structure may be included in a bra or other bra-related garment which includes at least the polymeric breast support structure. The bra may further include a fabric body to which the polymeric breast support structure is coupled/sewn in. In some embodiments, two cups may be included, including molded mesh cups, traditional bra cups, or any other suitable structure to provide cups for a bra. The polymeric breast support structure may be lined with fabric before being assembled into a bra. The polymeric breast support structure may be integrated within the bra or bra-related garment using any available methods, including sewing, bonding, the use of underwire channeling, etc. Further, the polymeric breast support can be sewn or bonded directly to the fabric of the garment, whereas a traditional metal underwire (which is indirectly attached via underwire channeling) cannot.

The polymeric material of the polymeric breast support structure may be a thermoplastic, elastomer, thermoplastic elastomer or any other polymeric material. The material may be a single polymeric material or combination of such polymeric materials that provide sufficient flexibility, hardness, strength and elasticity to comfortably support breast tissue. The material is heat resistant to at least 140 degrees Celsius so it is stable for washing and drying as part of a garment laundering process. The polymeric breast support structure may all be made of a uniform material, or alternatively, the various sub-components may be made of various polymeric materials and combined together in a subsequent manufacturing step to fuse/bond/couple the sub-components together to form the polymeric breast support structure. For clarity, the polymeric breast support structure does not incorporate any metallic material.

The polymeric breast support structure may be manufactured using a variety of available manufacturing processes. This may include additive manufacturing methods, such as 3D printing and injection molding, amongst any other suitable alternative manufacturing methods.

The polymeric breast support structure is differentiated from traditional underwire. Unlike flat underwire that exists in a singular plane, the polymeric breast support structure is 3-dimensional with a curvature that follows the inframammary fold of the wearer and accommodates different depths of the sternum, ribs, and side-body for a better, more contoured fit. This 3-dimensional design enhances comfort and tacking while reducing poking and red marks on the body. While the cross-sections of traditional underwires are rectangular, the cross-section of the polymeric breast support is rounded or otherwise curved to provide better comfort. The dimensions of the cross-section are substantially larger than traditional underwire, providing more surface area and better distribution of breast tissue weight to reduce pressure, pinching, and digging. Further, while the cross-section of an underwire remains uniform and the orientation of the cross-section does not change along the length of the underwire, the cross-section of the polymeric breast support varies (it may get thicker underneath of the breasts to support the weight of the breast tissue while tapering near the sternum and axilla for increased comfort) and the orientation of the cross-section twists to accommodate the natural curvature of the body so that the longer cross-sectional dimension of the polymeric breast support lies flush against the body at all points (near the axilla, down around the bottom of the breast, and up along the sternum) for better pressure distribution and comfort. At each of the ends of the polymeric breast support structure, the member tapers and the side exposed to the skin is contoured so that there is no abrupt endings or edges that could poke the axilla or sternum.

The polymeric breast support structure is made of a polymeric material, such that it is flexible and can conform to the body's natural curves and movements (i.e. bending, slouching, leaning over, etc.), changes in body size and tissue volume (i.e. from weight gain/loss, aging, pregnancy, monthly menstrual cycles, etc.) without poking and pinching, unlike traditional underwires made from rigid metal. The added flexibility afforded from a polymeric material allows the polymeric breast support to accommodate a wider range of bra cup sizes relative to a traditional metal underwire with limited flexibility. To ensure comfort on the body, the polymeric material should have a durometer hardness between 20 A and 95 A on the Shore A hardness scale. This softer, squishier material matches that of the skin itself far better than a hard metal, for a better feel. Further, the polymeric breast support structure is capable of recovering to its original shape after being substantially deformed, which increases the longevity of the garment, as traditional underwires will either break or remain in a deformed state after a significantly strong pressure is applied. Finally, the polymeric breast support should have a modulus of elasticity below 1000 MPa so that it is flexible enough to move with the body as the ribcage moves during breathing or as the person moves around. A traditional underwire has a modulus of elasticity of approximately 200,000 MPa, which makes it very rigid and produces discomfort as the person moves around or breathes.

The polymeric breast support is preferably made of a thermoplastic polyurethane (TPU), which could provide all the mechanical properties described above. In other embodiments, silicone could be used. A thermoplastic, an elastomer, or a thermoplastic elastomer (TPE), such as thermoplastic styrenic block copolymers (TPE-S/TPS), which are thermoplastic elastomer compounds based on styrene-butadiene-styrene or styrene-ethylene-butylene-styrene, could also be used, as long as the mechanical properties are suitable.

Figure 1:
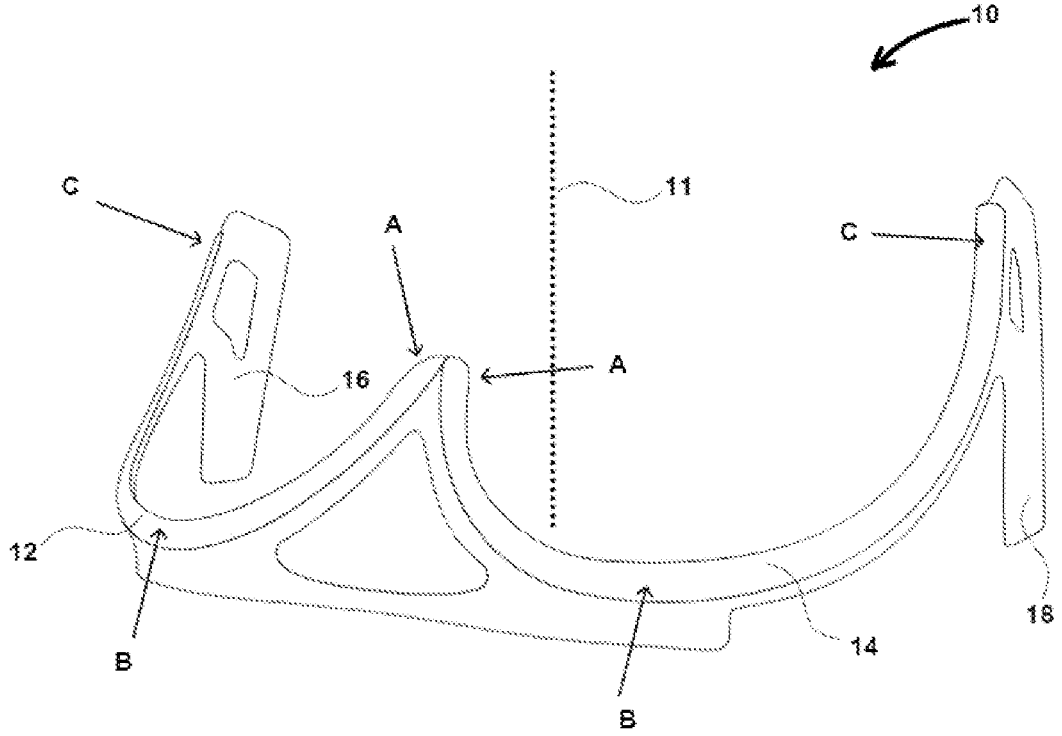
FIG. 1 depicts an exemplary polymeric breast support structure for a bra, consistent with some of the embodiments of the present invention.

The exemplary schematic of the polymeric breast support structure is shown in FIG. 1. The polymeric breast support structure 10 for a bra or other bra-related garment (not shown) consists of a right breast support 12 and a left breast support 14. Each of the right breast support 12 and the left breast support 14 comprises a curved contoured member shaped to fit a typical inframammary fold of the wearer's breasts. The inner surface of each curved contoured member faces the breast when worn and is shaped to fit around an approximately spherical shape. Each curved member begins at the axillary end C and proceeds down and around the breast along the inframammary fold section B and continues up to the sternum end A.

The polymeric breast support structure 10 is arranged around a central axis 11 which is perpendicular to the ground when the polymeric breast support structure 10 is worn by a user (not shown) standing vertically. The polymeric breast support structure 10 includes the right breast support 12 and the left breast support 14 circumferentially spaced apart from the right breast support 12 relative to the central axis 11. Accordingly, the polymeric breast support structure 10 is curved circumferentially about the central axis 11 to accommodate the contour of a user's torso.

Every edge of the polymeric breast support structure 10 may be curved to avoid the user experiencing discomfort from sharp edges or points while wearing the bra and/or polymeric breast support structure 10.

Figure 2:
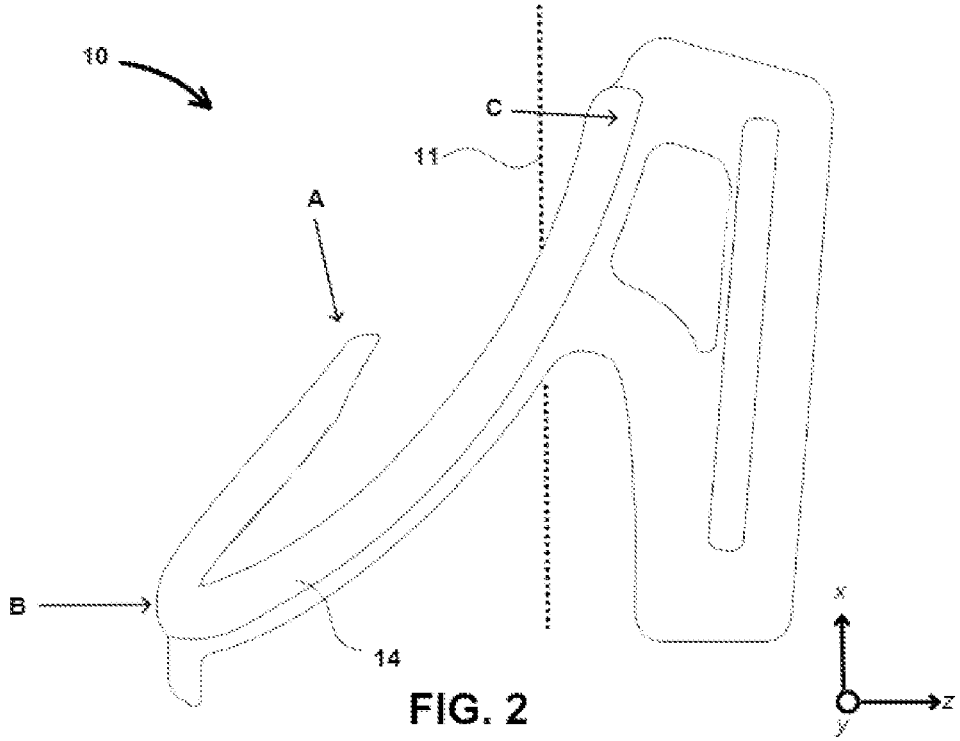
FIG. 2 depicts the side view of an exemplary polymeric breast support structure for a bra, consistent with some of the embodiments of the present invention.

FIG. 2 depicts a sideview of the polymeric breast support structure 10 arranged around a central axis 11 which is perpendicular to the ground when the polymeric breast support structure 10 is worn by a user (not shown) standing vertically. The polymeric breast support structure 10 is 3D contoured to fit the natural curvature of the wearer's torso in each of the x, y and z spatial directions. Unlike traditional metal underwires, which exist in a flat singular x-y plane, the polymeric breast support 10 has 3D dimensionality in the z-direction. The sternum end A, the inframammary fold section B, and the axillary end C of both breast supports 12, 14 are positioned at various measures along the z-axis (the z axis goes from the front chest towards the back of the user).

This dimensionality in the z-direction ensures that the breast supports 12, 14 rest comfortably on a user's chest and ribs at the bottom of each breast along the inframammary fold section B. The sternum end A has a greater z-value than the inframammary fold section B and it is closer to the central axis 11 to accommodate for the positioning and curvature of the user's sternum relative to the inframammary fold section B. The axillary end C has a greater z-value than both the inframammary fold section B and the sternum end A in order for the breast supports 12, 14 to extend far enough along the user's side body to capture all of a user's breast tissue, including the side breast tissue. The three-dimensional design in the x, y and z directions ensures a more comfortable, contoured fit compared to the traditional underwire that exists in only the x and y directions.

Figure 3:
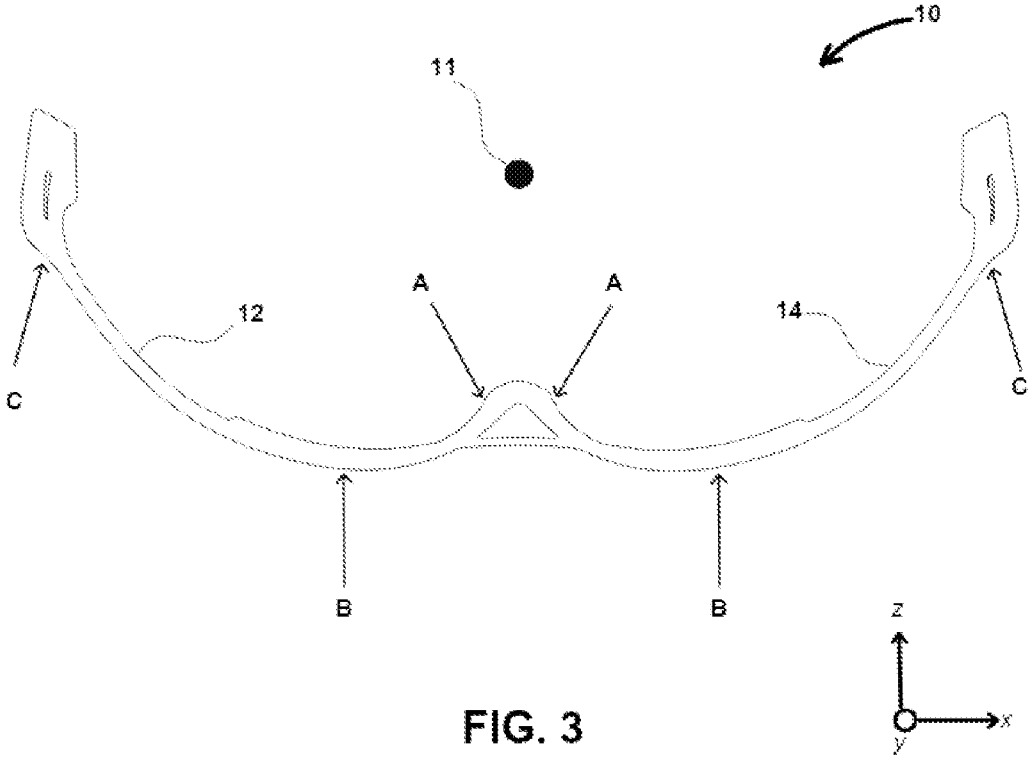
FIG. 3 depicts atop view of an exemplary polymeric breast support structure for a bra, consistent with some of the embodiments of the present invention.

The 3D dimensionality of the polymeric breast support structure 10 can also be seen in FIG. 3 which is a top-down view parallel along the central axis 11. As shown, the radial distance of the sternum end A is closest to the central axis 11. The proximity of the sternum end A to the central axis 11 ensures that the sternum end A tacks to the body. Tacking eliminates any measurable gap between the sternum end A and the body. Tacking increases the comfort and fit of the garment and creates a distinct separation between the left and right breast, which is important for the desired look and feel. Tacking also ensures that the polymeric breast support structure 10 sits on the body correctly so that maximum support can be provided. The radial distance of the inframammary fold section B to the central axis 11 is greater than the radial distance of the sternum end A to the central axis 11 to account for the shape of the user's ribs and chest which may protrude from the torso. The radial distance of the axillary end C to the central axis 11 is the largest radial distance to ensure that the axillary end C sits at the user's side body to comfortably contain any side breast tissue.

Figure 4:
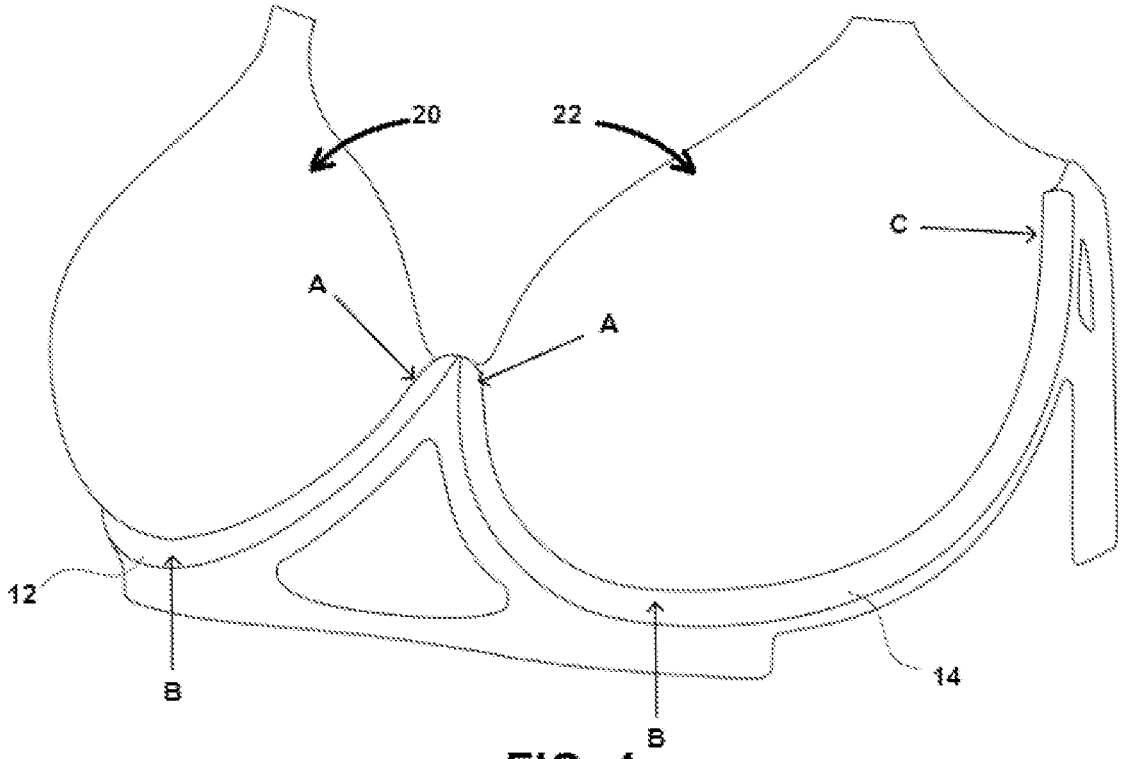
FIG. 4 illustrates construction details for integrating an exemplary polymeric breast support structure within a bra or other bra-related garment in accordance with embodiments of the present invention.
Figure 5:
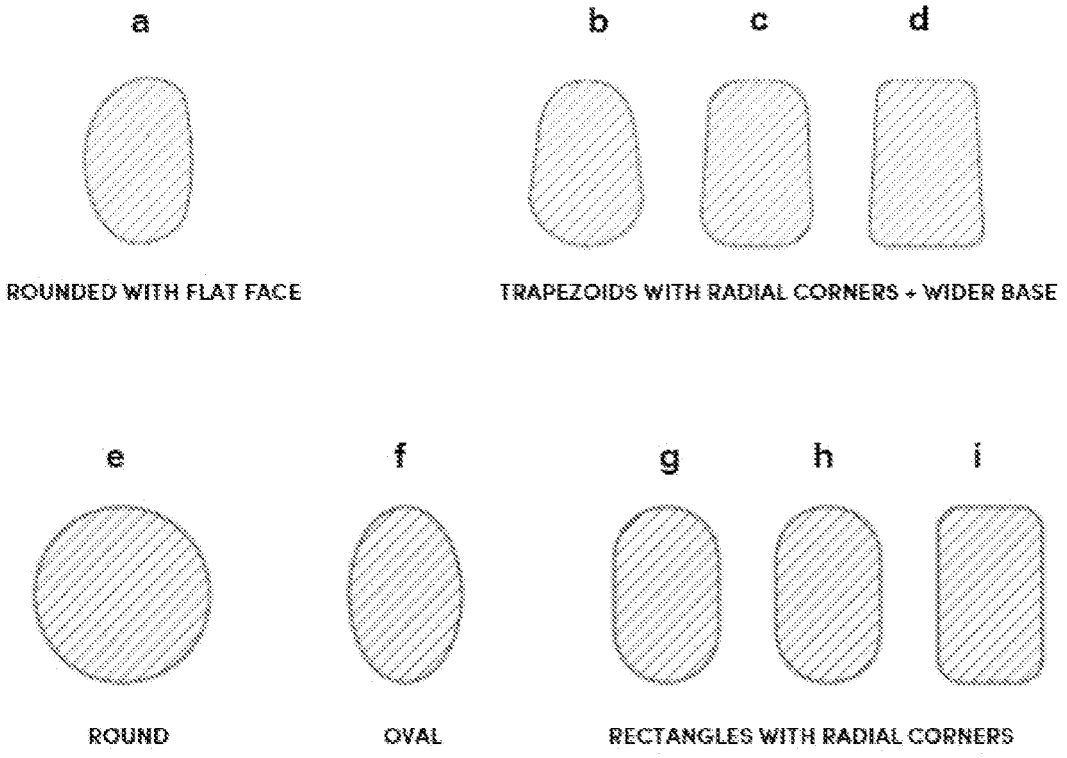
FIG. 5 illustrates various exemplary cross-sectional shapes of the breast supports of a polymeric breast support structure.

The polymeric breast support structure 10 is placed within the bra or bra-related garment such that the inframammary fold section B of each of the breast supports 12, 14 corresponds to a position that is directly underneath of each of the bottom of the user's breasts when the garment is worn. If the bra or other bra-related garment has traditional bra cups, the polymeric breast support structure 10 is positioned within the bra or other bra-related garment such that each of the breast supports 12, 14 aligns with each of the bra cups 20, 22 of the garment as shown in FIG. 4.

When integrated within the bra or bra-related garment, the polymeric breast support structure 10 provides support, separation, and shaping for the wearer's breasts. Each of the breast supports 12, 14 lift the breast tissue higher on the user's chest (i.e. closer to the direction of the user's head) by exerting a force equal or greater to the weight of the breast and in opposite direction to the downward weight of the breast, such that the breast tissue is supported and lifted. The polymeric breast support structure 10 contains two individual breast supports 12, 14, one for each breast, so that each breast rests within its own cup compartment, separate from the other breast. This creates separation of the user's breast tissue. Separation is a desired look for the user and it enhances comfort by preventing breast tissue from rubbing together. Further, the 3D-dimensionality of the breast supports 12, 14 provide a desired shaping by repositioning the wearer's breast tissue from the outside to the midline of their body (i.e. the breasts are centered inwards and projected forward as opposed to being spread out across the chest). The J or U-shape of the breast supports 12, 14 also contributes to a more rounded look of the breast tissue.

The cross-sections of the breast supports 12, 14 are rounded with no hard edges or sharp corners. The cross-sections may be circular, rounded, semi-circular, ovular, rectangular with rounded corners, trapezoidal with rounded corners, a rounded shape with a flat face, or any shape without hard or rough edges in cross-section. Exemplary cross-sections are shown in FIGS. 5*a-i*. The rounded curves of the cross-sections better follow the natural curves of the body, and there are no corners that dig into the user's body or provide discomfort. The dimensions of the cross-sections of the breast supports 12, 14 are larger than traditional underwire. Generally, the cross-section height of traditional underwire is less than 3 millimeters and the cross-section width is between 0.5 and 1 millimeter. The cross-section of the polymeric breast support structure 10 is between 5 and 15 millimeters in height and the width is approximately half of the height. In a representative embodiment of the polymeric breast support structure 10, the cross-section height of the breast supports 12, 14 is approximately 9 millimeters and the cross-section width is approximately 4 millimeters. The larger cross section of the breast supports 12, 14 relative to traditional underwire creates a wider surface area for the breast tissue to rest upon. The weight of the breast tissue is distributed over a larger surface area to reduce pressure, digging and red marks at the inframammary fold of the user.

Unlike traditional underwires, the cross-section of the breast supports 12, 14 is not uniform throughout its entire length. For example, the cross-section of the breast supports 12, 14 may widen at the very bottom near the inframammary fold section B where the weight of the breast tissue is greatest. This additional cross-sectional area provides supplementary support to lift and shape the breast tissue.

Similarly, in areas where there is less breast tissue weight to support, the cross-section of the breast supports 12, 14 may be reduced. The cross-sections of the breast supports 12, 14 decrease at the sternum end A and at the axillary end C for added comfort. By gradually decreasing the cross-sectional area of the sternum end A and the axillary end C, the breast supports 12, 14 do not abruptly terminate or include hard corners or sharp edges. Rather, the cross-sections at the sternum end A and the axillary end C gradually taper inwards as the ends are approached to eliminate any sharp edges or corners that might poke a user.

Figure 6A:
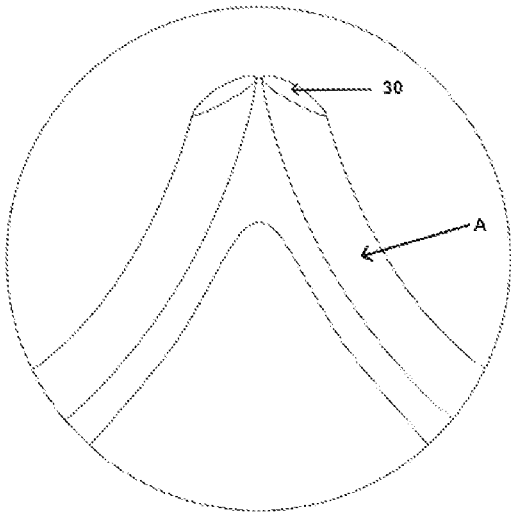
FIG. 6A shows a frontal, close-up view of the sternum ends of the left and right breast supports at the central panel of an exemplary polymeric breast support structure within a bra, consistent with some of the embodiments of the present invention.

In particular, the cross-section is decreased such that there is a tapering and sloping effect at the sternum end A. The sternum end A has an upper edge 30 which is not parallel to the ground when the polymeric breast support structure 10 is worn by a user (not shown) standing vertically, as this would create a sharp corner with a 90 degree right angle that could poke the user. Instead, as highlighted in FIG. 6A, the upper edge 30 tapers inwards and upwards moving from the sides of the body towards the center midline. This upward and inward tapering reduces painful poking at the sternum of the user for more comfort. Similar tapering is used at the axillary end C to reduce poking at the axilla of the user. The sloping and tapering along with the rounded curves of the sternum end A and the axillary end C maximize comfort for the user and eliminate the need for any plastic coating, end caps, or underwire casings which are often utilized for the ends of traditional underwire.

Figure 6B:
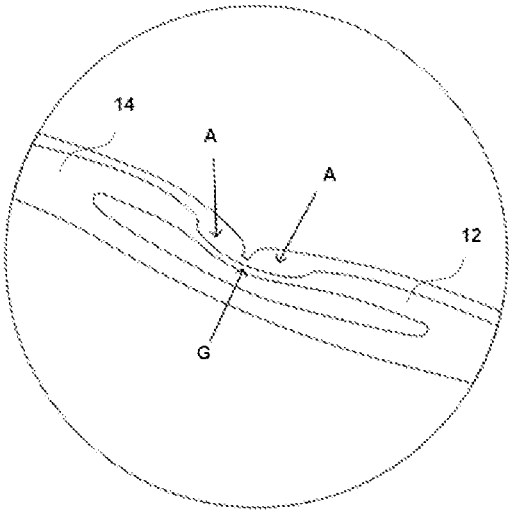
FIG. 6B depicts a top-down, close-up view of the sternum ends of the left and right breast supports at the central panel of an exemplary polymeric breast support structure within a bra, consistent with some of the embodiments of the present invention.

FIG. 6B is a close-up and top-down view of the sternum end A of the breast supports 12, 14 at the sternum of the user. The cross-section of the sternum end A is oriented such that the wider dimension of the breast supports 12, 14 is flush against the sternum. This orientation creates a very flat surface area at the point of contact with the user's sternum, which reduces poking at this very sensitive body part. In the embodiment where the right breast support 12 and the left breast support 14 are connected, they cooperate to form a wider, flat central panel G that provides enhanced comfort to the user.

Figure 7:
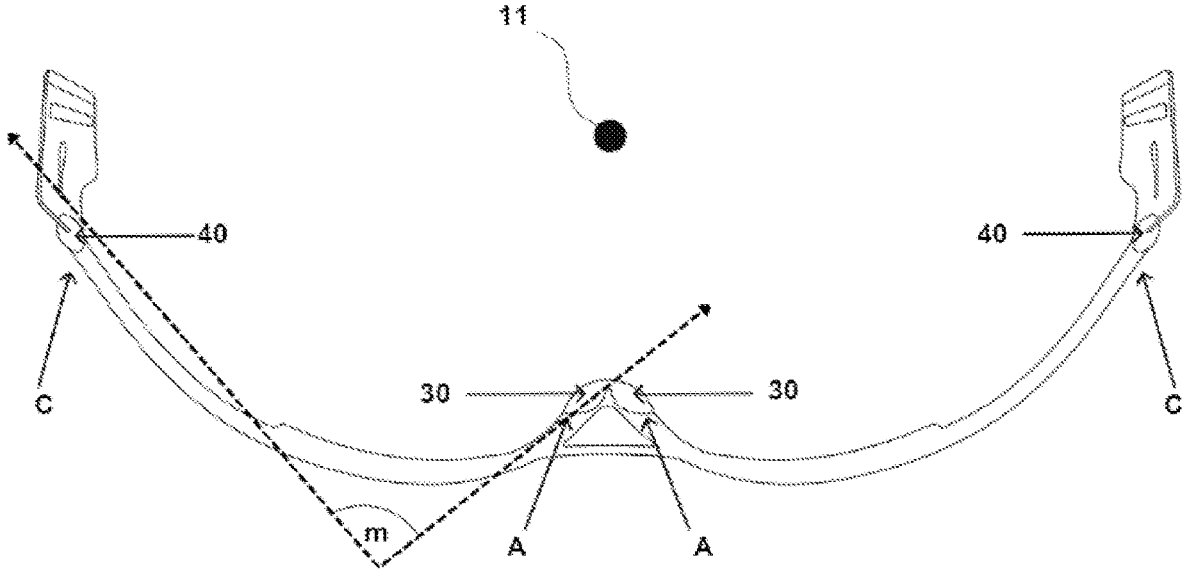
FIG. 7 depicts a top view that illustrates the change in orientation of the cross-section and the twist of the breast supports throughout an exemplary polymeric breast support structure for a bra.

The orientation of the cross-section changes along the length of the breast supports 12, 14. There is twisting of the breast supports 12, 14 to accommodate the natural curvature of the body, as the side-body is approximately perpendicular to the front chest. By incorporating a twist into the breast supports 12, 14 the longer dimension of the cross-section rests upon the body along the entire length of the breast supports 12, 14. This provides more surface area at each point along the length of the breast supports 12, 14 for better tissue distribution. This twisting also prevents the shorter dimension of the cross-section from laying flush with and digging into the body. FIG. 7 shows that the longer dimension of the cross-section of the sternum end A is at an approximately 90 degree angle to the longer dimension of the cross-section of the axillary end C. Specifically, the intersection of a line parallel to the longer dimension of the upper edge 30 of the sternum end A with a line parallel to the longer dimension of the upper edge 40 of the axillary end C forms a contouring angle m. The contouring angle m is approximately 90 degrees, which roughly corresponds to the perpendicular positioning of the front chest and side body. This is unlike traditional underwire where the longer cross-section of one end of underwire would form an approximate 180 degree angle with the longer cross-section of the other end of underwire. Further, the twist is incorporated along the entirety of the breast supports 12, 14 from the sternum end A, continuing through the inframammary fold section B, through to the axillary end C such that the longer dimension of the cross-section of the breast supports 12, 14 is flush with the body throughout. The twist highlights another important aspect of the polymeric breast support structure 10's 3D shape, as a traditional underwire exists flat in a 2-dimensional plane and does not incorporate twist.

Figure 8:
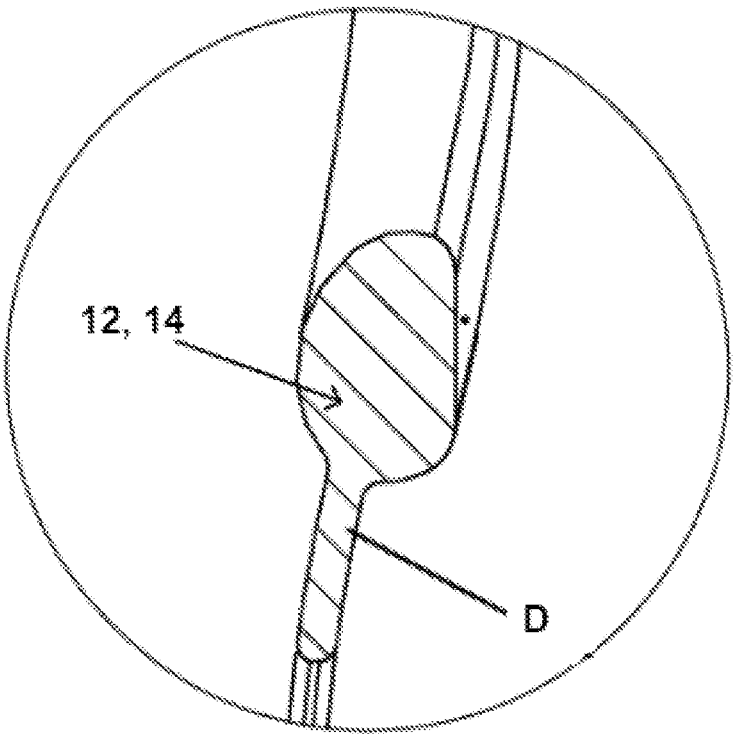
FIG. 8 shows a cross-sectional view of the breast supports and the sewing ledge.

In some embodiments, underneath each of the breast supports 12, 14 there is a sewing ledge D which follows the curvature of the breast supports 12, 14 in the x, y and z spatial directions. The sewing ledge D lies flat against the torso at all points along the length of the sewing ledge D. The width of the sewing ledge D should not exceed 2 millimeters, as it should be sufficiently thin to ensure that the sewing needles of sewing machines do not break when puncturing through the sewing ledge D as shown in FIG. 8. The thin layer serves as connection points for the polymeric breast support structure 10 to be easily sewn or bonded directly into a bra or bra-related garment without the need for the underwire channeling that is used in traditional underwires. The sewing ledge D can extend contiguously along the entire length of both breast supports 12, 14 or it may run intermittently in sections so that key anchor points can be sewn into the bra or bra-related garment.

Figure 9:
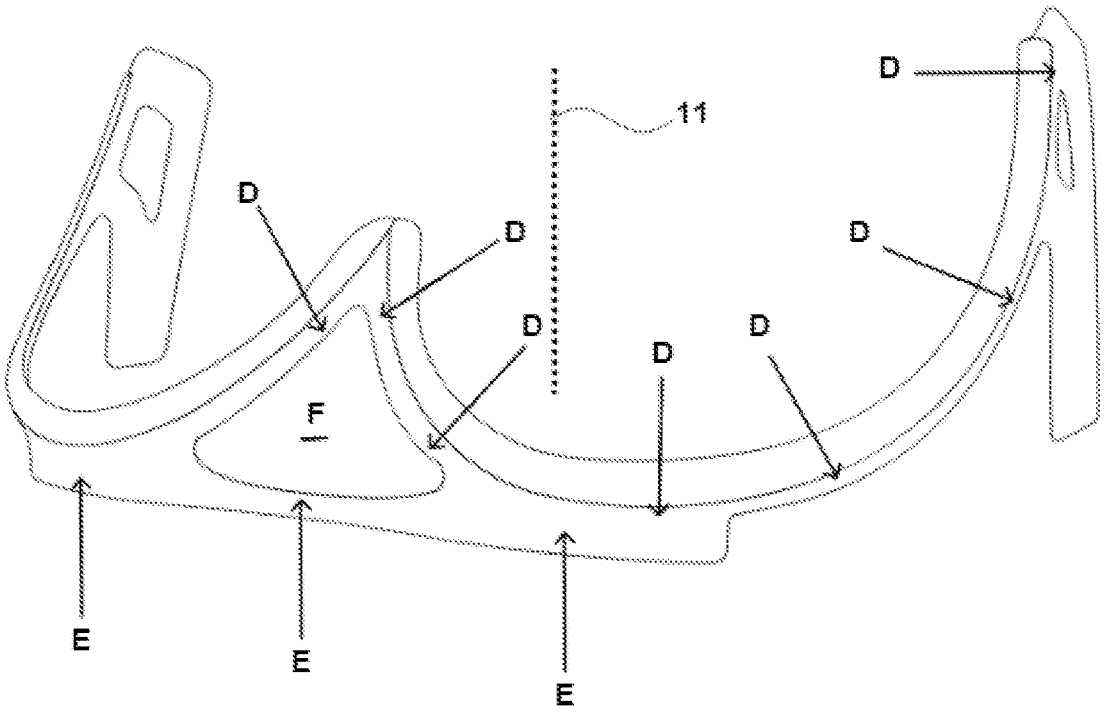
FIG. 9 depicts the sewing ledge, underband panel and aperture of an exemplary polymeric breast support structure within a bra, consistent with some of the embodiments of the present invention.

In other embodiments, the sewing ledge D may include an underband panel E. FIG. 9 illustrates a representative sewing ledge D and underband panel E. In bras or bra-related garments that contain an underband, the underband panel E provides additional strength to the underband of the garment to support the weight of the breast tissue. The underband panel E is designed around the central axis 11 such that its curves follow the natural contours of the user's torso. The underband panel E also serves to provide additional anchor points to couple and/or sew the fabric of the bra or other bra-related garment to the polymeric breast support structure 10. Therefore, the width of underband panel E should be sufficiently thin so that sewing needles can sew the underband panel E to the fabric or elastics of the bra or bra-related garment. The sewing ledge D and the underband panel E may cooperate to define an aperture F to provide flexibility, breathability, and/or space to assemble additional components of a bra to the polymeric breast support structure 10.

In other embodiments, the polymeric breast support structure 10 may include a first side support panel 16 (that aligns directly underneath of one of the user's axilla), a second side support panel 18 (that aligns directly underneath of the other of the user's axilla) circumferentially spaced apart from the first side support panel 16 relative to the central axis 11. The side support panels 16, 18 may connect at the axillary end C of the breast supports 12, 14 as shown in FIG. 1. The side support panels 16, 18 sit below the user's axilla for additional support of the user's side-body and side breast tissue. This helps to contain tissue and provide a smooth, streamlined appearance. Further, the side support panels 16, 18 cooperate to provide forward-directed support to a user's breasts for a desired aesthetic appearance. The thickness of the side support panels 16, 18 can vary depending on how much support is required. An aperture may also be present to allow for better breathability of the polymeric breast support structure 10 within the bra or bra-related garment. Portions of the side support panels 16, 18 should also be sufficiently thin such that they can be sewn or bonded directly into the fabric of the bra or bra-related garment. It must be noted that this offers the present invention a great advantage over underwires, since an underwire cannot be directly connected to a side support panel in this way.

The polymeric breast support structure 10 may be formed as a single, solitary component as shown in FIG. 1. In a single, cohesive component the sternum end A of the right breast support 12 is connected to the sternum end A of the left breast support 14. The connection of the right breast support 12 and the left breast support 14 cooperate to form a wider, flat central panel G as shown in FIG. 6B. The joining of the right breast support 12 and the left breast support 14 creates a seamless design where no components terminate at the sternum, providing even more comfort to the user. The inner side of the central panel G (i.e. the side facing the user's body) is preferably smooth and flat with no grooves or irregularities, to prevent discomfort and red marks.

However, in some embodiments, there will not be a central panel G and the sternum end A of the right breast support 12 will not be joined to the sternum end A of the left breast support 14 as shown in FIG. 10. In such an embodiment, the right breast support 12 is separate to the left breast support 14 and each component will be integrated into a respective cup of a bra or bra-related garment independently. The left breast support 14 is circumferentially spaced apart from the right breast support 12 relative to the central axis 11 such that the right breast support 12 is a mirror image of the left breast support 14. A traditional gore of a bra may be used to connect the left and right pieces together, as the material is soft and thin enough where traditional underwire channeling is not needed to connect the polymeric breast support structure 10 to the bra. Not joining the right breast support 12 to the left breast support 14 may allow for easier integration of the polymeric breast support structure 10 within the bra or bra-related garment, and it may better allow it to accommodate various styles of bras, such as a deep plunge bra. Other embodiments may or may not contain the side support panels 16, 18 and the underband panel E.

Further, there may be slight modifications to the polymeric breast support structure 10 in order to fit better within various bra styles. The right breast support 12 and the left breast support 14 may be adjusted to accommodate variations in the neckline of the bra. FIG. 11*a-d* shows some of the variations in the height of the sternum end A and the axillary end C for several common bra styles. A demi variation (FIG. 11*a*) is between a J and U-shaped curve where the axillary end C is slightly higher than the sternum end A; for this variation, the height of the sternum end A is about ½-⅔ of the height of the axillary end C. The sternum end A sits at the midline axis 33 while the axillary end C sits above it. A plunge variation (FIG. 11*b*) is more J-shaped and the axillary end C is significantly higher than the sternum end A; for this variation, the height of the sternum end A is about ⅓ of the height of the axillary end C. The sternum end A sits below the midline axis 33 while the axillary end C sits above it. A balconette variation (FIG. 11*c*) resembles a U-shaped curve where the axillary end C and sternum end A are both at about the same height. Both the sternum end A and the axillary end C are above the midline axis 33. A rocker wire variation (FIG. 11*d*) is more shallow and between a J and U-shaped curve where the axillary end C is low with the sternum end A even lower; here, the height of the sternum end A is about ⅔-¾ of the height of the axillary end C. The sternum end A sits just below the midline axis 33 while the axillary end C sits at it. It is to be understood that other ratios between the height of the sternum end and the height of the axillary end are also incorporated into the present invention.

Exemplary embodiments are disclosed in this description. It will be understood that the present invention incorporates other embodiments that are reasonable equivalents to the embodiments described in this disclosure, as evident to a person of reasonable skill in the art, and that the invention is only limited by the appended claims.

The invention claimed is:

1. A polymeric breast support structure of a breast support garment comprising:

a right breast support, wherein the right breast support comprises a curved contoured member that is configured to accommodate a shape of a breast of a user, wherein the curved contoured member comprises a cross-section, wherein the cross-section is between 5 and 15 millimeters long and between 2.5 and 7.5 millimeters wide and comprises no sharp corners, wherein the curved contoured member comprises an inner surface and an outer surface, wherein the curved contoured member comprises a sternum end and an axillary end;

wherein the curved contoured member is shaped to fit under a typical inframammary fold and to fit around a typical ribcage;

wherein the sternum end of the curved contoured member is configured to be located near a user's sternum when the breast support structure and the breast support garment is worn;

wherein the axillary end of the curved contoured member is configured to be located under a user's axilla when the breast support structure is worn;

wherein the inner surface of the curved contoured member is configured to follow the contour of a human ribcage when the breast support structure and the breast support garment is worn;

a left breast support, wherein the left breast support comprises a left curved contoured member, wherein the left curved contoured member comprises an axis and a cross-section perpendicular to the axis, wherein the cross-section is between 5 and 15 millimeters long and between 2.5 and 7.5 millimeters wide and comprises no sharp corners, wherein the left curved contoured member comprises an inner surface and an outer surface, wherein the left curved contoured member comprises a sternum end and an axillary end;

wherein the axis of the left curved contoured member is shaped to fit under a typical inframammary fold and to fit around a typical ribcage;

wherein the sternum end of the left curved contoured member is configured to be located near a user's sternum when the breast support structure and the breast support garment is worn;

wherein the axillary end of the left curved contoured member is configured to be located under a user's axilla when the breast support structure and the breast support garment is worn;

wherein the inner surface of the left curved contoured member is configured to follow the contour of a human ribcage when the breast support structure and the breast support garment is worn;

wherein the right breast support and the left breast support are made of a soft material whose Shore hardness ranges from approximately A20 to A95, which is heat resistant to at least 140 degrees Celsius, and which has a modulus of elasticity below 1000 MPa.

2. The polymeric breast support structure of claim 1, wherein the sternum end of the right breast support is connected to the sternum end of the left breast support at a sternum connection, wherein the sternum connection comprises an outer side and an inner side, wherein the inner side of the sternum connection faces a user's sternum when the polymeric breast support structure is worn, wherein the inner side of the sternum connection is smooth and flat and comprises no grooves.

3. The polymeric breast support structure of claim 1, further comprising:

a left side-support panel connected to the axillary end of the left breast support;

a right side-support panel connected to the axillary end of the right breast support.

4. The polymeric breast support structure of claim 1, wherein the soft material is a thermoplastic polyurethane.

5. The polymeric breast support structure of claim 1, wherein the soft material is silicone.

6. The polymeric breast support structure of claim 1, wherein the soft material is a thermoplastic.

7. The polymeric breast support structure of claim 1, wherein the soft material is a thermoplastic elastomer.

8. The polymeric breast support structure of claim 1, wherein the soft material is a thermoplastic styrenic block copolymer.

9. The polymeric breast support structure of claim 1, wherein the cross-section of each of the curved members is an oval.

10. The polymeric breast support structure of claim 1, wherein the cross-section of each of the curved members is a rectangle with rounded corners.

11. The polymeric breast support structure of claim 1, wherein the cross-section of each of the curved members is a trapezoid with rounded corners.

12. The polymeric breast support structure of claim 1, wherein the cross-section of each of the curved members is a rounded shape with a flat face, wherein the flat face is located closer to a user's breast when the polymeric breast support structure is worn.

13. The polymeric breast support structure of claim 1 wherein each of the curved members comprises a sternal portion, a middle portion, and an axillary portion, wherein the cross-section of the middle portion has a greater width than at least one of the cross-section of the sternal portion and the cross-section of the axillary portion.

14. The polymeric breast support structure of claim 1, further comprising an underband, wherein the underband is attached to the right breast support and the left breast support, wherein the underband is configured to fit around a user's ribcage under the right breast support and the left breast support, wherein the underband has a thin flat cross-section that may be integrated into the band of a bra.

15. The polymeric breast support structure of claim 1, further comprising a sewing ledge attached to the right breast support and the left breast support, wherein the sewing ledge has a thin flat cross-section that can be sewn to a garment.

16. The polymeric breast support structure of claim 1, wherein the breast support garment is one of the following: a brassiere, a bustier, a swimsuit top, a shapewear top, a camisole.

17. The polymeric breast support structure of claim 1, wherein when the breast support garment is worn by a user, a vertical distance between the sternum end and the lowest point of the user's inframammary fold is between ⅔ and ¾ of a vertical distance between the axillary end and the lowest point of the user's inframammary fold.

18. The polymeric breast support structure of claim 1, wherein when the breast support garment is worn by a user, a vertical distance between the sternum end and the lowest point of the user's inframammary fold is approximately the same as a vertical distance between the axillary end and the lowest point of the user's inframammary fold.

19. The polymeric breast support structure of claim 1, wherein when the breast support garment is worn by a user, a vertical distance between the sternum end and the lowest point of the user's inframammary fold is between ½ and ⅔ of a vertical distance between the axillary end and the lowest point of the user's inframammary fold.

20. The polymeric breast support structure of claim 1, wherein when the breast support garment is worn by a user, a vertical distance between the sternum end and the lowest point of the user's inframammary fold is approximately ⅓ of a vertical distance between the axillary end and the lowest point of the user's inframammary fold.

* * * * *